US008720148B2

(12) United States Patent
Engstrom

(10) Patent No.: US 8,720,148 B2
(45) Date of Patent: May 13, 2014

(54) SET OF PANELS

(75) Inventor: Nils-Erik Engstrom, Trelleborg (SE)

(73) Assignee: Pergo (Europe) AB, Trelleborg (SE)

( * ) Notice: Subject to any disclaimer, the term of this patent is extended or adjusted under 35 U.S.C. 154(b) by 47 days.

(21) Appl. No.: 13/086,931

(22) Filed: Apr. 14, 2011

(65) Prior Publication Data

US 2011/0271631 A1 Nov. 10, 2011

(30) Foreign Application Priority Data

May 10, 2010 (DE) ..... 10 2010 020 089

(51) Int. Cl.
*E04F 15/02* (2006.01)

(52) U.S. Cl.
CPC ..... *E04F 15/02038* (2013.01)
USPC ..... 52/582.1; 52/391; 52/588.1

(58) Field of Classification Search
USPC ..... 52/582.1, 582.2, 584.1, 587.1, 586.1, 52/585.1, 391; 428/50
See application file for complete search history.

(56) References Cited

U.S. PATENT DOCUMENTS

| | | | | |
|---|---|---|---|---|
| 2004/0211143 | A1* | 10/2004 | Hanning | 52/578 |
| 2008/0236088 | A1 | 10/2008 | Hannig | |
| 2010/0043333 | A1* | 2/2010 | Hannig | 52/582.2 |

FOREIGN PATENT DOCUMENTS

| | | | | |
|---|---|---|---|---|
| DE | 20 2009 004 530 | | 6/2009 | |
| WO | WO 00/47841 | | 8/2000 | |
| WO | WO 2006/043893 | | 4/2006 | |
| WO | WO 2008/068245 | * | 6/2008 | 52/582.2 |
| WO | WO 2009/066153 | | 5/2009 | |

OTHER PUBLICATIONS

Notice of Allowance for U.S. Appl. No. 13/437,597 dated Apr. 29, 2013.
Non-Final Office Action for U.S. Appl. No. 12/747,454 dated May 10, 2013.
International Search Report for Application No. PCT/EP2010/006772 dated Mar. 31, 2011.

* cited by examiner

*Primary Examiner* — William Gilbert
(74) *Attorney, Agent, or Firm* — Jenkins, Wilson, Taylor & Hunt, P.A.

(57) ABSTRACT

The invention relates to a set of panels, in particular floor panels, comprising a first panel and at least a second panel. The panels are respectively provided with a first edge and with a second edge, wherein the first edge and the second edge are configured to establish a connection between the first and the second panel The first edge has a lower lip with a step, the second edge can have a downwardly open locking groove. A separate clip can be provided which can be attached to the first edge or the second edge and has a moveable clip head, which in the connected state of the panels can cooperate with a locking surface on the second edge or the first edge, respectively, in order to lock the panels vertically relative to the plane of laying.

12 Claims, 2 Drawing Sheets

SET OF PANELS

CROSS REFERENCE TO RELATED APPLICATIONS

This application is a Non Provisional, claiming the priority of German Patent Application No. 102010020089.1, filed May 10, 2010, the entire disclosures of which are incorporated herein by reference in their entireties.

The invention relates to a set of panels comprising a first panel and at least a second panel, wherein the panels are respectively provided with a first edge and with a second edge and wherein the first edge of the first panel and the second edge of the second panel are configured to establish a connection between the first and the second panel.

Such a set of panels is known, for example, from WO 00/47841. In this case, a first edge has a lower lip with a step, while a second edge has a downwardly open locking groove. In a connected state of the panels, the step cooperates with the downwardly open locking groove so that a positive-fit connection in a horizontal direction is formed. By means of a relative movement of the panels with respect to each other, the two edges can in this case be connected vertically relative to the plane of laying.

In order to lock the panels vertically relative to the plane of laying, a separate clip is provided, which is attached to one of the edges and has a moveable clip head, which in the connected state of the panels cooperates with a locking surface on the other edge.

A connection as described in WO 00/47841 can advantageously be used in floor panels. It facilitates the laying of the floor panels because the floor panels can be locked with each other by a simple downward movement of one of the panels.

However, there is a need for an improvement of the edges including the clip with regard to the joint strength and to further simplify their manufacture.

The invention is therefore based on the object of providing a set of panels, the edges of which can be connected with each other, wherein the connection between the edges has good properties and is comparatively simple to produce.

The object on which the invention is based is achieved with the combination of features of claim 1. Preferred exemplary embodiments can be found in the dependent claims.

According to claim 1, it is provided that the clip head, in a locking position, exerts a force on a locking surface of the second edge which urges the second edge of the second panel against the lower lip of the first edge of the first panel, wherein the locking position lies between an undeformed initial position and an assembly position. In this case, the assembly position is the position in which the clip is maximally deformed when the profiles are connected. Preferably, the locking position is closer to the assembly position than to the initial position.

This means that the clip continues to remain deformed in the locking position. Due an appropriate configuration of the clip head, and the locking surface cooperating with the clip head, it can be ensured that, even given certain manufacturing tolerance's, the clip head always rests securely against the locking surface and exerts a force due to which the one lower contact surface of the second edge rests securely on a contact surface of the lower lip of the first edge.

As was already explained, the locking position in a preferred embodiment is closer to the assembly position than to the initial position. If, for example, the deformation (deformation work) in the assembly position is set to 100%, then in a preferred embodiment, the deformation in the locking position is supposed to be at least 50%. Furthermore, in a preferred embodiment, the deformation in the locking position, relative to the maximum deformation in the assembly position; may exceed 60 or even exceed 70%.

In a preferred embodiment, the clip is inserted, with a fastening area, in a clip groove having a lower groove wall, an upper groove wall and a groove bottom. In this case, in a preferred embodiment, the clip head does not protrude beyond an imaginary extension of the lower groove wall in the initial position, wherein the clip head sweeps over this imaginary extension during the movement, starting from the initial position into the assembly position.

In addition, it can be provided that the clip including the clip head, does not protrude beyond an imaginary extension of the upper groove wall.

Preferably, the upper groove wall and the lower groove wall are parallel to each other. The upper groove wall and the lower groove wall can in this case be parallel to the plane of laying or can also include an angle. The angle can be, for example 0° to 20°.

When the panels are connected, the movable clip head can execute a pivoting movement about a pivot axis located between the lower and upper groove wall or between their imaginary extensions. In this case, the pivot axis preferably extends along the edges.

The fastening area can have four fastening surfaces separate from one another, of which two cooperate with the upper groove wall and the other two with the lower groove wall. Preferably, the four fastening surfaces, in the direction of the groove bottom, are in this case arranged offset relative to one another. The cross section of the fastening area in this case approximately has a zigzag shape on which the moveable clip head is formed to be pivotable.

A fifth fastening surface of the fastening area can be provided, which rests against the groove bottom. The fifth fastening surface thus ensures, that the clip is fixed in the direction of the groove bottom.

The invention will now be explained in more detail with reference to an exemplary embodiment shown in the figures. In the figures.

Figure 1:
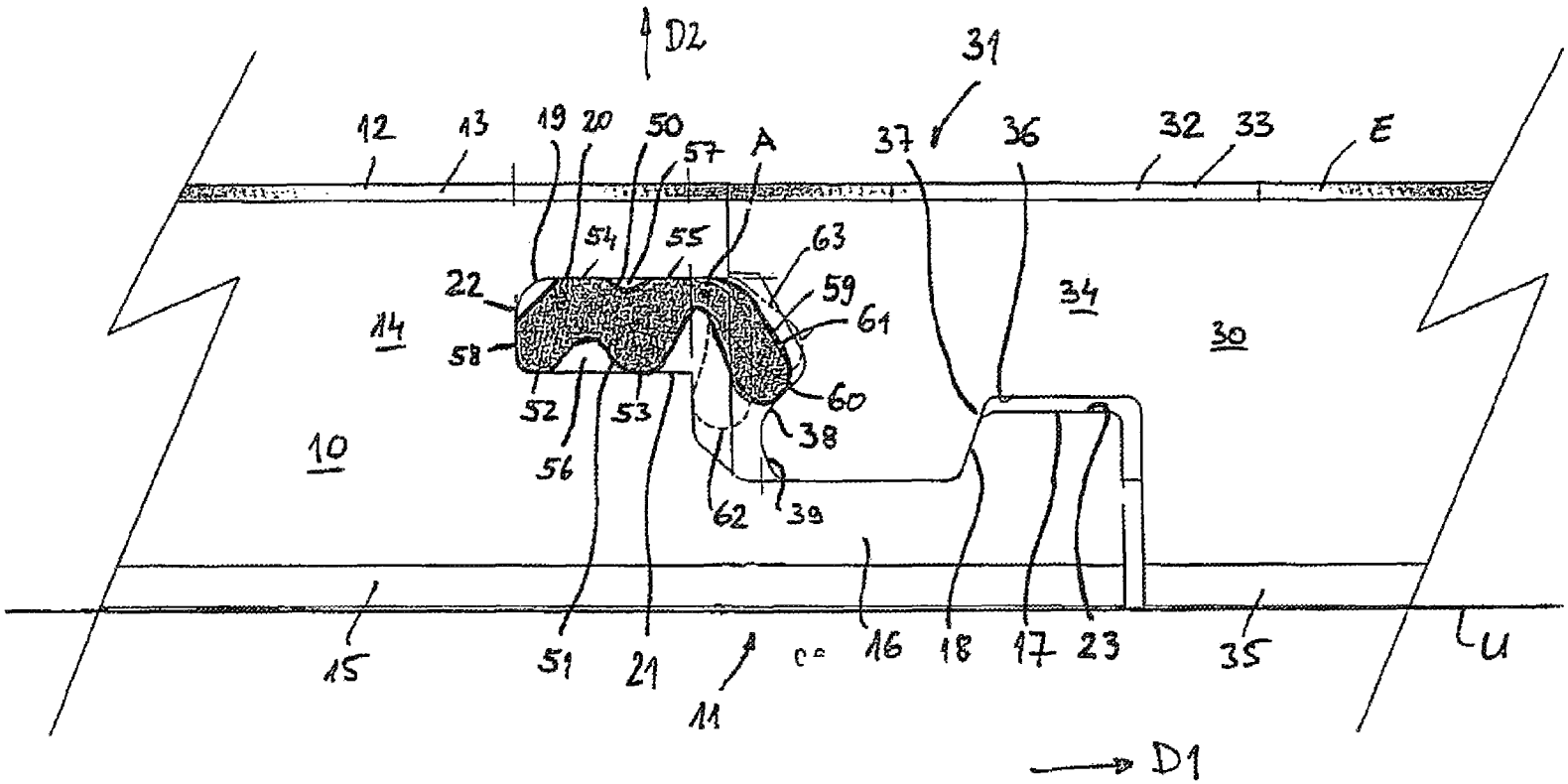
FIG. 1 shows two panels in the connected state.

FIG. 1 shows a cross section of a detail of a first panel 10 and a second panel 30, each of which are supposed to have a rectangular basic shape. It can be seen in FIG. 1 that the first panel 10 has a first edge 11 cooperating with a second edge 31 of the second panel 30. The first panel 10 in this case also has a second edge which corresponds to the second edge 31 of the second panel 30 but is not shown in FIG. 1. The same applies, mutatis mutandis, to the second panel 30, which also has a first edge which is not shown and corresponds to the first edge 11 of the first panel 10. Preferably, the first edge and the second edge are disposed opposite to one another on a panel.

The panels 10, 30 preferably are floor panels resting on an underlying floor U. A plane of laying E, in which the upper sides 12, 32 of the panels 10, 30 lie, extends parallel to the underlying floor U. The upper sides 12, 32 in this case comprise a decorative layer 13, 33 attached to a core 14 and 34, respectively. The core 14, 34 can consist of MDF or HDF, but can also be formed from a different material.

On an underside, the panel 10 has an underlayer 15. The corresponding underlayer of the constructionally identical panel 30 is designated with the reference numeral 35.

The first edge 11 has a lower lip 16 with a step 17 forming a substantially vertical locking surface 18.

In the connected state of the panels 10, 30 or the edges 11, 31 as it is shown in FIG. 1, the step 17 reaches into a locking groove 36 of the second edge 31 open towards the underlying floor U. The locking groove has in this case a substantially vertical locking surface 37 which cooperates with the locking surface 18 of the step 17. The cooperation of the substantially vertical surfaces 18, 37 prevents the second panel 30 from being detachable from the first panel 10 in the direction D1, i.e. parallel to the plane of laying E.

A lock of the panels 10, 30 in the vertical direction D2 is ensured by a clip, which in its entirety is designated with 50. In this case, in the example of the floor panels, the vertical direction D2 is perpendicular to the plane of laying E.

The clip comprises a fastening area 51 which is disposed in a clip groove 19 of the first panel 10. The clip groove 19 has an upper groove wall 20 and a lower groove wall 21, both of which extend parallel to the plane of laying E. In addition, the clip groove 19 has a groove bottom 22.

The fastening area 51 of the clip 50 has four fastening surfaces 52, 53, 54, 55 separate from one another, with lower fastening surfaces resting against the lower groove wall 21 and upper fastening surfaces 54, 55 resting against the upper groove wall 20. There is an interstice 56 between the lower fastening surfaces 52, 53. Such an interstice can also be found between the upper fastening surfaces 54, 55 and is designated with 57. The fastening surfaces 52, 53, 54, 55, in the direction of the groove bottom, or in this case in the direction D1, are arranged offset relative to one another. The clip 50, which is preferably of plastic, but which cart also consist of MDF or HDF, thus as a certain resilience or compressibility between the groove walls 20, 21, which can be utilized for clamping the clip 50 into the groove 19 in a simple manner.

A fifth fastening surface 58 adjoining to the lower fastening surface 52, rests against the groove bottom 22 and ensures a fixation of the clip in the groove 19 in the horizontal direction or in the direction opposite to the direction D1.

Moreover, the clip 50 has a pivotable clip head 59 which is which is connected to the fastening area 51 of the clip 50 so as to be pivotable about a pivoting axis A. FIG. 1 in this case shows the clip head 59 in a locking position in which the clip head 59, with a head end 60, rests against a locking surface 38 of the second edge 31. The head end 60 in this case has an approximately semi-circular configuration. In the direction towards the underlying floor U, the locking surface 38 transitions into a sliding surface 39, along which the clip head 59 slides with a sliding face 61 when the panels 10, 30 are connected with each other by means of a vertical downward movement of the second panel 30. The sliding surface 39 in this case transitions into the locking surface 38 without any appreciable edges or steps.

In addition, FIG. 1 indicates two further positions of the clip head 59, which are in each case shown by means of dashed lines. The locking head 59 can assume an assembly position 62 in the process, so that the second edge 31, when the panels are connected, can be lowered, to the extent that it abuts against the lower lip 16 of the first edge 11. However, the clip head 59 is strongly deformed in the assembly position 62 so that the restoring forces urge the clip head upwards again until the clip head 59 is clamped against the locking surface 38 with its head end 60.

Furthermore, the initial position 63, in which the clip head 59 and the clip 50, respectively, are undeformed, can be seen in FIG. 1. It can be clearly seen that the locking position deviates from the initial position. This means that the clip 50 is still deformed in the locking position, and that this deformation ensures that the clip head 59, with its head end 60, presses-against the locking surface 38. This leads to the clip head 59 pressing the second edge 31 against the lower lip 16, via the locking surface 38.

Figure 2:
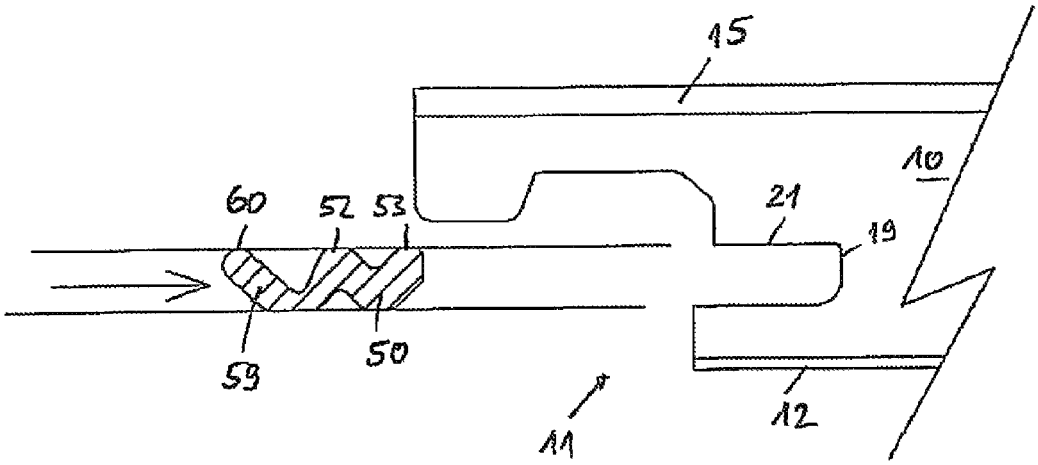
FIG. 2 shows a clip during insertion into a clip groove.

FIG. 2 shows the panel 10 with its edge 11, with the panel now standing-on its head, so that the lower side 12 is disposed at the bottom and the underlayer 15 at the top. FIG. 2 shows how the clip 50 can be inserted into the groove 19 by means of a linear movement. In this case, the clip 50 is in the undeformed state, with the clip head 59 assuming the initial position 63 (see FIG. 1). In this state, the lower fastening surfaces 52, 53 of the fastening area 51 of the clip 50 and the head end 60 lie in an extension of the lower groove wall 21.

As it is shown in FIG. 2, the clip can be reeled off a drum prior to insertion into the groove 21. Because of its shape, in which the fastening areas 52, 53 and the head end 60 on the one hand, and the fastening areas 59, 50 on the other hand respectively lie in one line, the clip 50 can be reeled onto a drum without any appreciable warping.

It can be seen from FIG. 1, that, seen in the vertical direction, the head end 60, at least in the assembly position 62 of the clip head 59, lies below a plane parallel to the plane of laying E, in which an upper surface 23 of the step 17 lies.

Due to the above-mentioned zigzag shape, the clip has a maximal material thickness which is smaller than the distance of the groove walls 20, 21. Apart from a constricted area near the pivoting axis A, by means of which the pivotability of the clip head 59 relative to the fastening area 51 is adjusted, the material thickness varies only very little. It is thus possible for the clip produced according to the preferred production by means of the extrusion process to be uniformly and quickly cooled off.

The invention claimed is:

1. A set of floor panels, the set of floor panels comprising a first panel and at least a second panel;

wherein the first panel comprises a first edge;

wherein the second panel comprises a second edge, the first edge and the second edge being configured to establish a connection between the first and second panel;

wherein the first edge has a distally protruding lower lip;

wherein the first edge and the second edge each comprise horizontally active locking surfaces that in a connected condition of the panels cooperate with each other to thereby provide locking in a direction in the plane of the floor panels and perpendicular to the first and second edges, the horizontally active locking surface of the first edge being provided at the distally protruding lower lip, whereas the horizontally active locking surface of the second edge is provided at the lower side of the second panel;

wherein the second edge is adapted to connect with the first edge via a relative vertical movement between the first and the second panels;

wherein a separate deformable clip is disposed between the first and second edges, the clip being provided in a groove in one of the first and second edges and having a moveable clip head, which in the connected condition of the panels cooperates with a vertically active locking surface at the other one of the first and second edges, thereby locking the panels in a direction perpendicular to the plane of the panels;

wherein the moveable clip head can adopt at least three positions, the at least three positions comprising:

an initial position wherein the moveable clip is in a free condition;

an assembly position, in which the clip is maximally deformed during connecting the panels; and a locking position, the locking position being the position in the connected condition of the panels and being located in between the initial position and the assembly position;

wherein the clip head in the locking position exerts a force on the vertically active locking surface which urges the second edge of the second panel against the first edge of the first panel;

wherein the groove in which the separate clip is provided has an upper groove wall and a lower groove wall;

wherein the upper groove wall and the lower groove wall are substantially parallel to each other and include an angle in respect to the plane of the connected floor panels;

wherein the locking position is closer to the assembly position than to the initial position; and wherein the clip head does not protrude beyond an imaginary extension of the lower groove wall in the initial position.

2. The set of panels of claim 1, wherein the clip is fastened in the groove by a fastening area.

3. The set of panels of claim 1, wherein the clip head is pivotable.

4. The set of panels of claim 3, wherein the clip is fastened in the groove by a fastening area and wherein the fastening area has four fastening surfaces spaced apart from one another, of which two engage the upper groove wall and the other two engage the lower groove wall.

5. The set of panels of claim 4, wherein the clip comprises a substantially uniform body thickness with the exception of a constricted portion defining a pivot point for the clip head.

6. The set of panels of claim 3, wherein the clip comprises a substantially uniform body thickness with the exception of a constricted portion defining a pivot point for the clip head.

7. A set of floor panels, the set of floor panels comprising a first panel and at least a second panel;

wherein the first panel comprises a first edge;

wherein the second panel comprises a second edge, the first edge and the second edge being configured to establish a connection between the first and second panel;

wherein the first edge has a distally protruding lower lip;

wherein the first edge and the second edge each comprise horizontally active locking surfaces that in a connected condition of the panels cooperate with each other to thereby provide locking in a direction in the plane of the floor panels and perpendicular to the first and second edges, the horizontally active locking surface of the first edge being provided at the distally protruding lower lip, whereas the horizontally active locking surface of the second edge is provided at the lower side of the second panel;

wherein the second edge is adapted to connect with the first edge via a relative vertical movement between the first and the second panels;

wherein a separate deformable clip is disposed between the first and second edges, the clip being provided in a groove in one of the first and second edges and having a moveable clip head, which in the connected condition of the panels cooperates with a vertically active locking surface at the other one of the first and second edges, thereby locking the panels in a direction perpendicular to the plane of the panels;

wherein the moveable clip head can adopt at least three positions, the at least three positions comprising:

an initial position wherein the moveable clip is in a free condition;

an assembly position, in which the clip is maximally deformed during connecting the panels; and a locking position, the locking position being the position in the connected condition of the panels and being located in between the initial position and the assembly position;

wherein the clip head in the locking position exerts a force on the vertically active locking surface which urges the second edge of the second panel against the first edge of the first panel;

wherein the groove in which the separate clip is provided has an upper groove wall and a lower groove wall;

wherein the upper groove wall and the lower groove wall are substantially parallel to each other and include an angle in respect to the plane of the connected floor panels;

wherein the locking position is closer to the initial position than to the assembly position; and wherein the clip head does not protrude beyond an imaginary extension of the lower groove wall in the initial position.

8. The set of panels of claim 7, wherein the clip is fastened in the groove by a fastening area.

9. The set of panels of claim 7, wherein the clip head is pivotable.

10. The set of panels of claim 9, wherein the clip is fastened in the groove by a fastening area and wherein the fastening area has four fastening surfaces spaced apart from one another, of which two engage the upper groove wall and the other two engage the lower groove wall.

11. The set of panels of claim 10, wherein the clip comprises a substantially uniform body thickness with the exception of a constricted portion defining a pivot point for the clip head.

12. The set of panels of claim 9, wherein the clip comprises a substantially uniform body thickness with the exception of a constricted portion defining a pivot point for the clip head.

* * * * *